US005263255A

United States Patent [19]

Watson

[11] Patent Number: 5,263,255

[45] Date of Patent: Nov. 23, 1993

[54] POPCORN UTENSIL

[76] Inventor: Terry Watson, Decatur, Ga.

[21] Appl. No.: 808,881

[22] Filed: Dec. 18, 1991

[51] Int. Cl.[5] ..... A47J 43/28

[52] U.S. Cl. ..... 30/325; 30/324; 30/326; 294/55

[58] Field of Search ..... 30/324, 325, 326; D7/653, 681; 294/55; 425/284, 118

[56] References Cited

U.S. PATENT DOCUMENTS

| | | | |
|---|---|---|---|
| D. 134,599 | 12/1942 | Beck | 30/324 |
| D. 163,028 | 4/1951 | Donaldson | 30/324 |
| 255,923 | 4/1882 | Bradner | 294/55 |
| 283,634 | 8/1883 | Meyer | 30/324 |
| 335,390 | 2/1886 | Silbermann et al. | 425/284 |
| 510,286 | 12/1893 | Osterman | 30/324 |
| 1,121,701 | 12/1914 | Willis | 30/324 |
| 1,211,062 | 1/1917 | Bowman | 30/324 |
| 1,263,780 | 4/1918 | Lieb | 30/324 |
| 2,795,043 | 6/1957 | Fleischer | 30/324 |
| 3,822,976 | 7/1974 | Moonan | D7/681 X |

*Primary Examiner*—Douglas D. Watts
*Assistant Examiner*—Hwei-Siu Payer

[57] ABSTRACT

An elongated, trough-like utensil for eating buttered popcorn by scooping it from a container. Long enough to reach into a deep container, one end of the utensil includes a finger stop which can be held between the middle and index fingers. The finger stop also forms a dam to prevent grease or melted butter on the popcorn from coming into contact with the fingers. Distal from the stop, the trough has a rounded end which provides a smooth surface to facilitate thrusting the trough into popcorn. Near the rounded end, the bottom of the trough defines an aperture of sufficient size to allow unpopped kernels of corn to escape from the trough before they can slide down it and into a user's mouth.

2 Claims, 1 Drawing Sheet

POPCORN UTENSIL

SUMMARY OF INVENTION

A utensil for scooping up popcorn from a container so that one can eat the popcorn from this utensil. It is therefore designed specifically to eat popcorn from.

DETAILED DESCRIPTION

Figure 1:
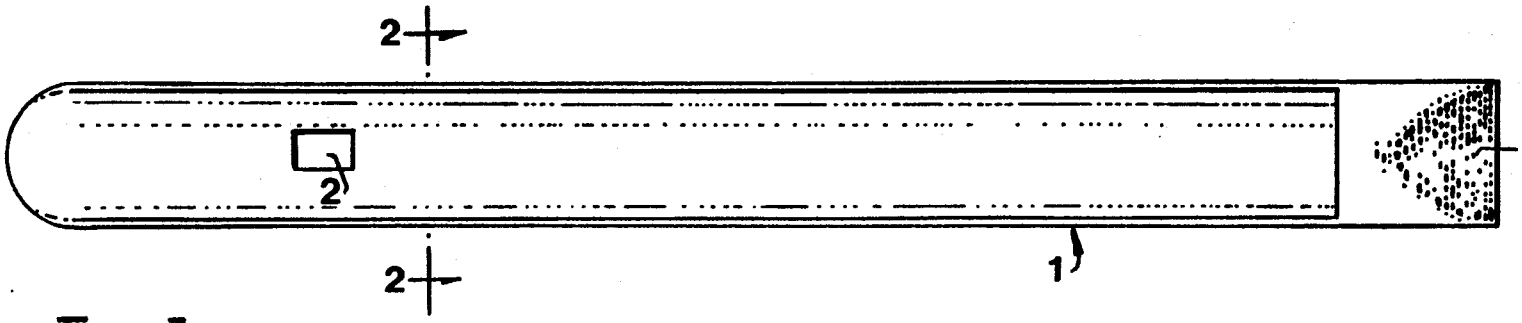
FIG. 1 is a plan vies of the utensil according to the present invention.
Figure 2:
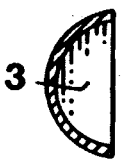
FIG. 2 is a cross-section taken along line 2—2 of FIG. 1.
Figure 3:
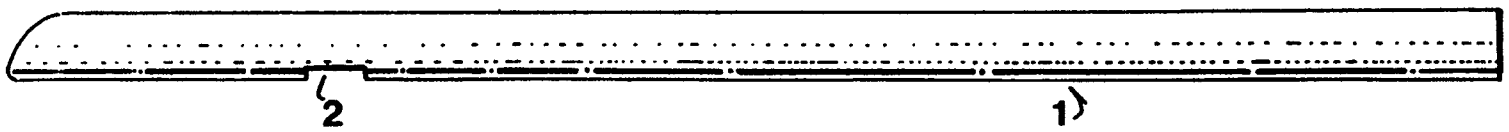
FIG. 3 is an elevation view of the utensil according to FIG. 1.
Figure 4:
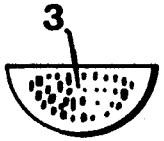
FIG. 4 is an end view of the utensil according to FIG. 1.
Figure 5:
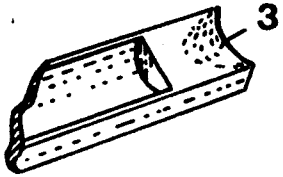
FIG. 5 is a fragmentary section shown in perspective of one end of the utensil according to FIG. 1.

The popcorn utensil 1 is an implement that is about ten or so inches long. The distance from the front to the finger stop measures about nine inches; from the finger stop to the end of the utensil, about an additional inch. Being of such length or slightly longer allows for a sufficient amount of popcorn to be gathered on this utensil. Said implement is about seven eighths of an inch ($\frac{7}{8}$") wide. And said implement is also slightly curved to prevent the popcorn from rolling off the sides.

A hole 2 is provided so that unpopped kernels can fall back into the container.

The popcorn utensil has a finger stop 3, so that the popcorn will not come in contact with one's finger. Additionally, the finger stop gives one a point at which to hold and manipulate said utensil. To use said instrument, one can place this utensil between the frontal sides of the middle and index fingers, with the thumb used to stabilize it. Then with one's wrist, one can manipulate said implement.

Said instrument can be made from a host of materials, ranging from metallic to non-metallic.

I claim:

1. A hand-held utensil adapted for scooping, and then raising to the mouth of a user, popcorn which may be coated with a liquid such as melted butter and which may contain popcorn kernels, comprising:

(a) an elongated, open trough having a pair of side walls, each side wall having an outer edge, the outer edges extending longitudinally generally parallel to each other;

(b) a finger stop fixedly attached to one end of the trough, the stop extending transversely between said side walls, the stop forming a dam for preventing the liquid from coming into contact with the hand of the user; and (c) the trough having a rounded end which is disposed distal from the finger stop, the rounded end and the side walls forming a single unitary piece, the rounded end having an outer edge, the outer edge of the rounded end and of the side walls forming a U-shaped edge, the rounded end being adapted for thrusting the utensil into the popcorn and for contacting the mouth, the trough defining at least one aperture which is disposed proximate with the rounded end, the aperture being larger in size than the kernels.

2. A hand-held utensil adapted for scooping, and then raising to the mouth of the user, popcorn which may be coated with a liquid such as melted butter and which may contain popcorn kernels, comprising:

(a) an elongated trough having a pair of side walls, each side wall having an outer edge, the outer edges extending longitudinally generally parallel to each other;

(b) a finger stop fixedly attached to one end of the trough, the stop extending transversely between said side walls, the finger stop forming a dam for preventing the liquid from coming into contact with the hand of the user; and (c) the trough having a rounded end which is disposed distal from the finger stop, the rounded end and the side walls forming a single unitary piece, the rounded end having an outer edge which together with said outer edges of the side walls forms a U-shaped edge, the U-shaped edge being disposed generally in a single imaginary plane, the rounded end being adapted for thrusting into the popcorn and for contacting the mouth, the trough defining at least one aperture which is disposed proximate with the rounded end, the aperture being larger in size than the kernels, edges of the aperture being spaced apart from the U-shaped edge.

* * * * *